US007152753B2

(12) United States Patent
Huffman et al.

(10) Patent No.: US 7,152,753 B2
(45) Date of Patent: Dec. 26, 2006

(54) RE-SEALABLE CAN MECHANISM

(76) Inventors: Todd A. Huffman, 908 Seabrook Dr., Plano, TX (US) 75023; Christopher R. Barker, 606 Belhaven Dr., Allen, TX (US) 75013; Brian T. Lipker, 20801 69th Ave., Bradenton, FL (US) 34211

( * ) Notice: Subject to any disclaimer, the term of this patent is extended or adjusted under 35 U.S.C. 154(b) by 0 days.

(21) Appl. No.: 10/922,818

(22) Filed: Aug. 20, 2004

(65) Prior Publication Data

US 2005/0236411 A1 Oct. 27, 2005

Related U.S. Application Data

(60) Provisional application No. 60/564,814, filed on Apr. 23, 2004.

(51) Int. Cl.
*B65G 51/18* (2006.01)

(52) U.S. Cl. ..... 220/254.4; 220/906; 220/272

(58) Field of Classification Search ..... 220/254.4–4, 220/406, 272, 273, 263, 269, 270
See application file for complete search history.

(56) References Cited

U.S. PATENT DOCUMENTS

| | | | | |
|---|---|---|---|---|
| 1,576,353 A | | 3/1926 | Olsen | |
| 1,735,056 A | | 11/1929 | Richey | |
| 3,259,265 A | | 7/1966 | Stuart | 220/24 |
| 3,325,044 A | * | 6/1967 | McCutcheon | 220/212.5 |
| 3,338,462 A | * | 8/1967 | Reynolds et al. | 220/791 |
| 3,622,034 A | * | 11/1971 | Lutzker et al. | 220/787 |
| 3,698,593 A | * | 10/1972 | Cvacho et al. | 220/203.29 |
| 3,700,135 A | | 10/1972 | Collier | 220/25 |
| 3,727,787 A | | 4/1973 | Gregory | 220/25 |
| 3,884,382 A | * | 5/1975 | Ball | 220/272 |
| 3,913,779 A | * | 10/1975 | Blazer et al. | 220/243 |
| 3,952,911 A | | 4/1976 | Bozek et al. | 220/269 |
| 3,982,656 A | | 9/1976 | Kusmierski et al. | 220/238 |
| 4,391,385 A | | 7/1983 | Rausing | 220/269 |
| 4,393,979 A | | 7/1983 | Ball et al. | 220/270 |
| 4,442,950 A | | 4/1984 | Wilson | 220/269 |
| 4,463,866 A | | 8/1984 | Mandel | 220/269 |
| 4,673,099 A | | 6/1987 | Wells | 220/269 |
| 4,681,238 A | | 7/1987 | Sanchez | 220/260 |
| 4,747,511 A | | 5/1988 | Dutt et al. | 220/307 |
| 4,815,628 A | | 3/1989 | Wehnert, III | 220/352 |
| 4,877,129 A | * | 10/1989 | Wells | 220/269 |
| 4,880,137 A | | 11/1989 | Wells | 220/269 |
| 4,946,061 A | | 8/1990 | Hobbs | 220/243 |
| 5,062,542 A | | 11/1991 | Morton | 220/269 |
| 5,080,249 A | | 1/1992 | Shock | 220/269 |
| 5,085,339 A | | 2/1992 | Roth et al. | 220/269 |
| 5,108,003 A | | 4/1992 | Granofsky | 220/257.2 |
| 5,139,163 A | | 8/1992 | Diaz | 220/258 |

(Continued)

FOREIGN PATENT DOCUMENTS

EP 0 204 214 5/1986

(Continued)

*Primary Examiner*—Lien M. Ngo
(74) *Attorney, Agent, or Firm*—Westman, Champlin & Kelly, P.A.

(57) ABSTRACT

A device is disclosed for re-closing an opening in a can having a tab opener. The device comprises a mount piece having an overall shape and flexibility that enables it to be pushed through at least one aperture formed in the tab opener thereby securing the device to the tab opener. The device further comprises a plug portion attached to the mount piece and configured to engage and at least partially close an opening in the can.

13 Claims, 8 Drawing Sheets

U.S. PATENT DOCUMENTS

| | | | | |
|---|---|---|---|---|
| 5,145,085 | A | 9/1992 | Yost | 220/269 |
| 5,186,348 | A | 2/1993 | Steiner | 220/270 |
| 5,351,853 | A | 10/1994 | Shock | 220/729 |
| 5,799,815 | A | 9/1998 | Lang | 220/258 |
| 6,032,816 | A | 3/2000 | Martin | 220/212 |
| 6,059,137 | A | 5/2000 | Westwood et al. | 220/258 |
| 6,073,797 | A | 6/2000 | Barous | 220/716 |
| 6,098,830 | A | 8/2000 | Jamieson | 220/258 |
| 6,105,200 | A | 8/2000 | Cooper | 15/257.01 |
| 6,158,608 | A | 12/2000 | Schlattl | 220/253 |
| 6,347,720 | B1 | 2/2002 | Schley | 220/258 |
| 6,427,861 | B1 | 8/2002 | Cho | 220/269 |
| 6,460,719 | B1 | 10/2002 | Finmark | 220/258.5 |

FOREIGN PATENT DOCUMENTS

| | | |
|---|---|---|
| EP | 1 247 752 A1 | 4/2001 |
| GB | 2 085 394 | 4/1982 |

* cited by examiner

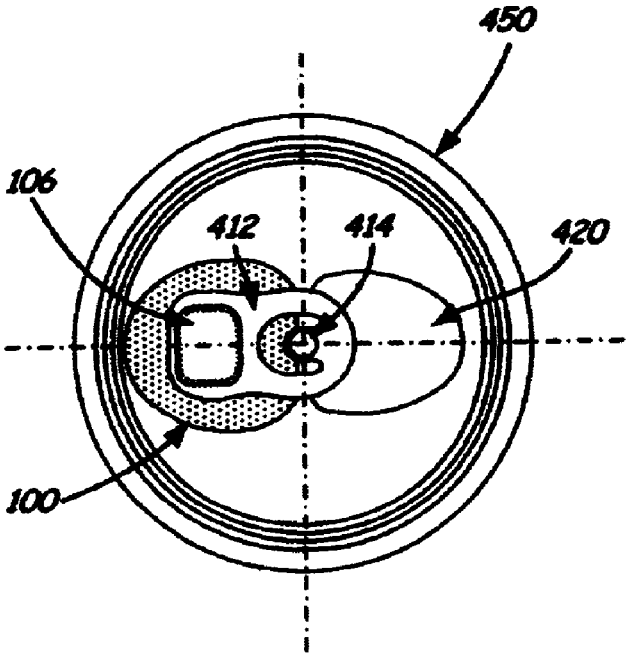
FIG. 6A
FIG. 6B
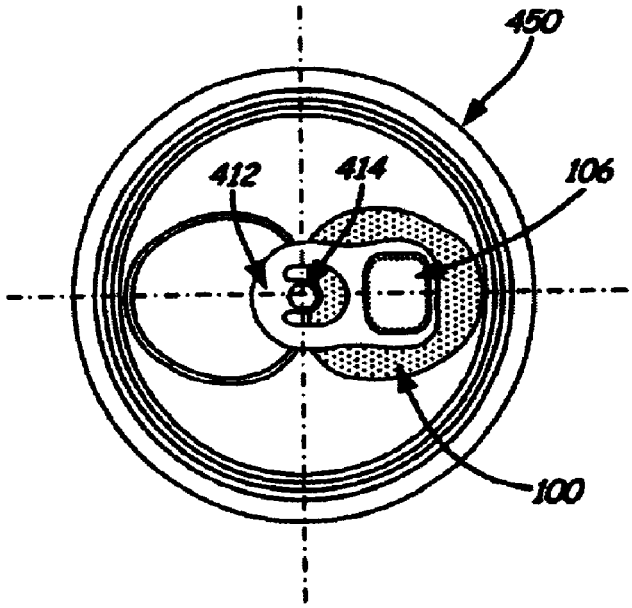

RE-SEALABLE CAN MECHANISM

The present application is based on and claims the benefit of U.S. Provisional Patent Application Ser. No. 60/564,814, filed on Apr. 23, 2004, the content of which is hereby incorporated by reference in its entirety.

BACKGROUND OF THE INVENTION

Embodiments of the present invention generally pertain to mechanisms that enable a can to be re-sealed after opening. Certain specific embodiments are configured to interface with a typical can and enable it to be re-sealed by a consumer.

Cans are well known by consumers around the world and are available in a variety of shapes and sizes. Although they are widely used, there are many problems associated with the typical can.

One example of a problem that can occur applies specifically to cans used to store carbonated beverages. When the can is opened, carbonation escapes and, over a short time, the beverage becomes flat. This is also a problem for alcoholic and other beverages. In many instances, the entire contents of the can are not immediately consumed after opening. As a result, the remaining beverage is wasted as the lack of carbonation is undesirable to most consumers. Due to this waste and the lack of economical resealing mechanisms previously know in the art, it is difficult to market larger sized cans.

Another problem associated with cans occurs after opening when the open mouth of the can allows dirt or other unwanted debris to enter and contaminate the contents of the can, such as in the case with carbonated, alcoholic, non-alcoholic, juice and water beverages. This can result in undesirable beverage conditions and a wasteful disposal of remaining beverage. Yet another problem with cans occurs when an at least partially full can is accidentally spilled, such as in the case with carbonated, alcoholic, non-alcoholic, juice and water beverages. Spilled beverages can lead to stains and other unwanted results. Can spills occur frequently and may happen under potentially dangerous circumstances such as while driving an automobile.

Because of the problems associated with cans, their use has become increasingly unpopular. There remains a need for a convenient and cost-efficient means to re-seal an opened can.

SUMMARY OF THE INVENTION

Embodiments of mechanisms for re-sealing cans are disclosed. The mechanisms are adaptable to cans currently on the market. The mechanisms can be marketed as a stand alone (i.e., a post-purchase product), or alternatively, they can be applied by a manufacturer (e.g., a cola bottling or canning company) to existing cans (e.g., during a filling stage of the manufacturing process). In one embodiment, a can re-sealing mechanism includes an inner and outer flange configured to engage inner and outer surfaces of a can.

BRIEF DESCRIPTION OF THE DRAWINGS

FIGS. 6A and 6B are top views of a can illustrating operation and alignment of a re-sealing mechanism.

DETAILED DESCRIPTION OF ILLUSTRATED EMBODIMENTS

In accordance with one aspect of the present invention, mechanisms disclosed herein for re-sealing cans are each a sole component separate from the can itself. In one embodiment, the mechanisms are adaptable to cans currently on the market. The mechanisms can be marketed as a stand alone (i.e., a post-purchase product), or alternatively, they can be applied by a manufacturer (e.g., a cola bottling or canning company) to existing cans (e.g., during a filling stage of the manufacturing process).

Figure 1A:
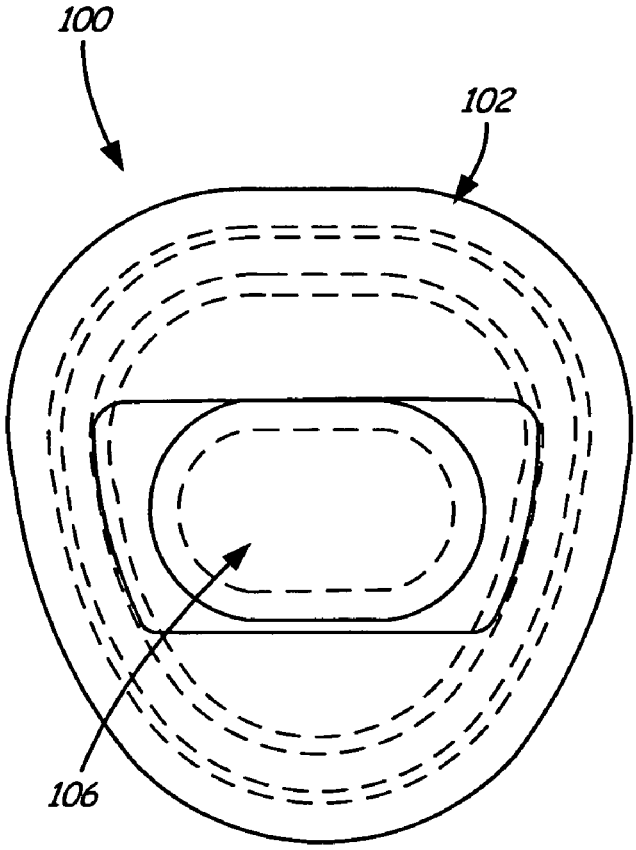
FIGS. 1A and 1B are top and side views, respectively, of a mechanism for re-sealing a can.
Figure 1B:
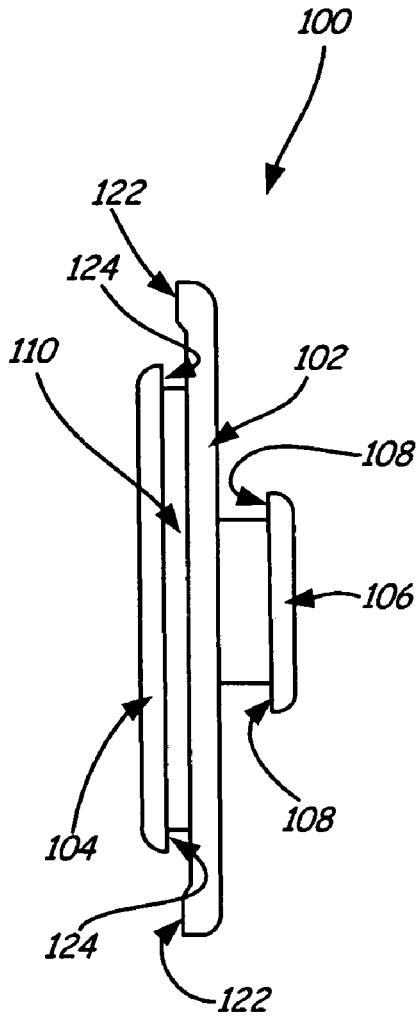

FIGS. 1A and 1B, in accordance with one aspect of the present invention, are top and side views, respectively, of a mechanism 100 for re-sealing a can. Mechanism 100 includes a plug portion comprising an outer flange 102 and inner flange 104 configured to engage opening-area surfaces of a can or similar container. In accordance with one embodiment, the plug portion is configured to at least partially close the opening in the can. Flanges 102 and 104 are sized such that they are larger than the can opening thus enabling them to extend beyond the diameter of the opening. In accordance with another embodiment, inner flange 104 is constructed of a resilient material, examples include but not limit to FDA approved silicone elastomers, silastic silicone rubber, etc., such that it may deform or elongate thereby enabling it to be pushed through the opening of the can. Inner flange 104 is also illustratively constructed of a material that is biased toward returning to its neutral shape (i.e., the shape illustrated in FIG. 1B). In one embodiment, inner flange 104 is constructed of a shape-memory polymer.

Once pushed through the can opening, inner flange 104 returns to its original shape, and also forms to the shape of the can opening, thereby engaging the inner surface of the can and creating a seal to some degree. In accordance with one aspect of the present invention, inner flange 104 has a total circumference greater than the circumference of the opening in the can enabling inner flange 104 to completely cover the opening. In accordance with one embodiment, inner flange 104 has a total circumference at least 5 percent greater than the circumference of the opening in the can. In another embodiment, inner flange 104 has a total circumference more than 25 percent greater than the circumference of the opening in the can providing a greater sealing configuration. Of course, any percent greater than the circumference of the can opening is within the scope of the present invention.

In accordance with another embodiment, outer flange 102 is constructed of a similar flexible material and configured to engage the outer surface of the can proximate the opening. The engagement of inner flange 104 and outer flange 102 with the surfaces of the can proximate the opening creates a seal to some degree thereby minimizing or discouraging the escape of air, carbonation, and/or the contents contained within the can. Inner flange 104 and outer flange 102 may be constructed of the same, similar, or different materials, ranging from flexible to more rigid materials, without departing from the scope of the present invention. In particular, outer flange 102 very well may be constructed of a relatively rigid material such as rubber or a hard plastic.

In accordance with another embodiment, re-sealing mechanism 100 comprises a plurality of flanges, wherein at least one flange engages an inner surface of the can and at least one flange engages an outer surface of the can. In accordance with the illustrated embodiment, at least one flange configured to engage the outer surface has a greater total circumference than any flange engaging an inner surface. The larger outer flange protects the smaller inner flange discouraging dust and other debris from collecting on the inner flange. In addition, the larger outer flange discourages it from being pushed through the opening in the can.

In accordance with another aspect of the present invention, tab mount piece 106 is an attachment mechanism utilized to secure mechanism 100 to a can or similar container. In accordance with one embodiment, mechanism 100 attaches to a typical can tab through at least one of the apertures commonly formed therein. For instance, mount piece 106 may be configured to engage both apertures formed in a typical can tab. In this embodiment, mount piece 106, which is illustratively, but not necessarily, constructed of a resilient material, deforms as it is pushed through the aperture in the can tab. Mount piece 106 is pushed through the can tab aperture until flange 108 engages the top edge of the tab. Flange 108 securely holds mechanism 100 to the can tab during use. Mount tab 106 may be constructed from the same or similar material as outer flange 102 or from a different material. Also, mount piece 106 may be constructed from either a flexible material or a more rigid material depending on the requirements of a given application.

In accordance with one embodiment, tab mount piece 106 is a relatively mushroom-shaped attachment mechanism which is utilized to secure mechanism 100 to a can. In accordance with yet another embodiment, mount tab 106 remains outside the can opening when utilized to secure mechanism 100 to a can.

It is important to note that other variations may be utilized to secure mechanism 100 to a can without departing from the scope of the present invention. These alternatives include, but are not limited to, fusing mechanism 100 to the can tab using heat or connecting using an adhesive such as glue or a known chemical reaction bonding process. Alternatively, mechanism 100 may be physically clipped to the tab.

Figure 2:
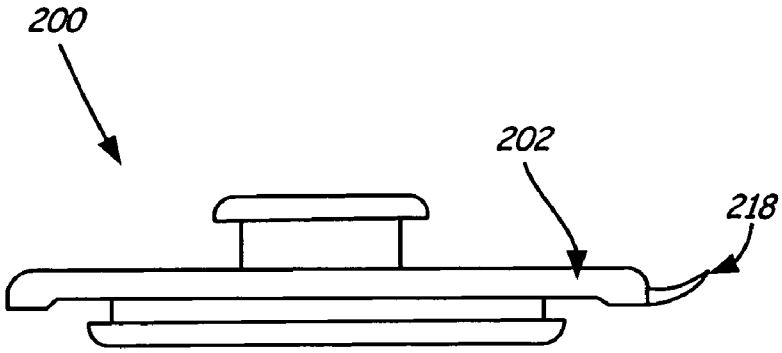
FIG. 2 is a side view of a re-sealing mechanism including a tab opener.

In accordance with one embodiment, FIG. 2 is a side view of mechanism 200 for re-sealing a can including a tab opener 218 attached to an outer flange 202 to allow for easy removal of mechanism 200. Elements of FIG. 2 having the same or similar reference numerals as utilized in FIG. 1 illustratively have the same or substantially similar functionality. One aspect of the present invention allows for mechanism 200 to be repeatedly inserted and removed from a can opening. As alluded to previously, the use of mechanism 200 to re-seal a can encourages a sealing configuration. The engagement of mechanism 200 within the can opening can cause removal to be difficult. In accordance with the illustrated embodiment, removal tab 218 can be grasped and pulled, thereby deforming the inner flange enabling easy removal of mechanism 200 from the can opening.

Figure 3:
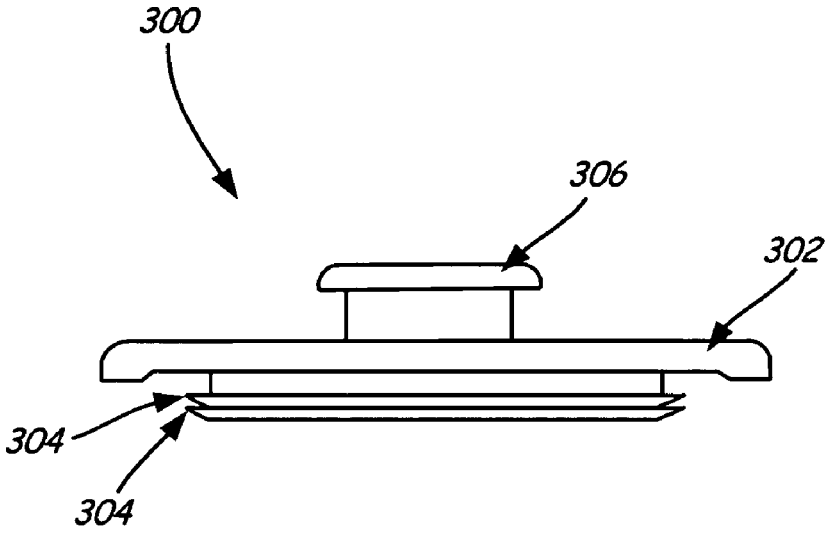
FIG. 3 is a side view of a re-sealing mechanism including a plurality of sealing flanges.

In accordance with another embodiment of the present invention, FIG. 3 is a side view of a re-sealing mechanism 300. Mechanism 300 is illustratively similar to mechanism 100 but includes multiple inner flanges 304. The use of multiple flanges provides a more reliable sealing engagement. Tab mount piece 306 attaches mechanism 300 to a can tab as previously explained.

The multiple flanges help to secure the inner engagement by essentially providing a back-up flange in case the upper flange is to slip out of the opening of the can for any reason (e.g., can could be dropped, squeezed or dented). In accordance with one aspect of the present invention, a second or third flange (or more) is provided.

FIGS. 4–8 are directed to operation of mechanism 100 for re-sealing cans (FIG. 1). Elements of FIGS. 4–8 having the same or similar reference numerals as utilized in previous Figures illustratively have the same or substantially similar functionality. Mechanism 100 can actually be configured similar to any mechanism described in accordance with previous embodiments.

Figure 4:
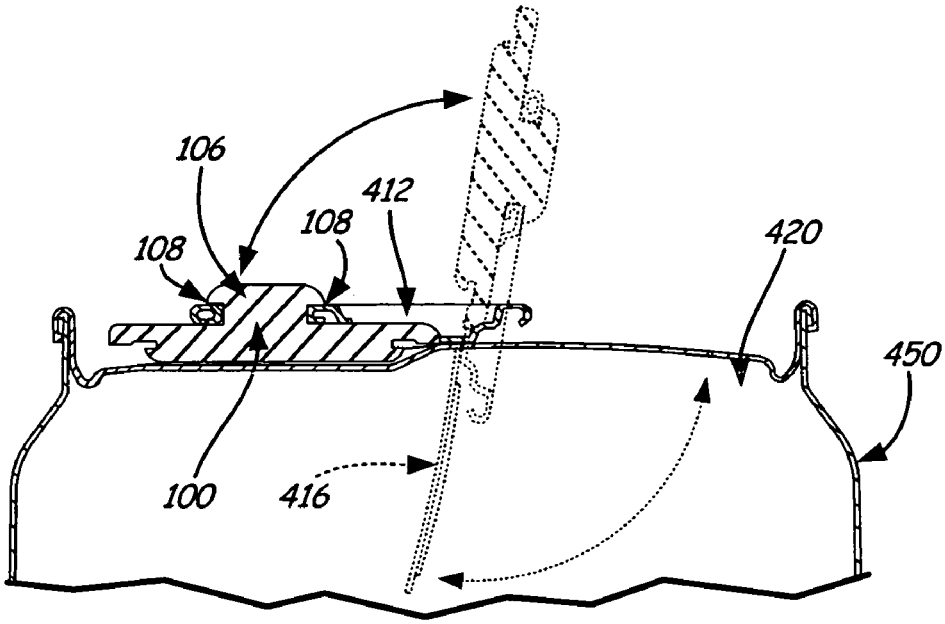
FIG. 4 is a schematic side cross-section view illustrating functionality associated with a re-sealing mechanism.
Figure 5:
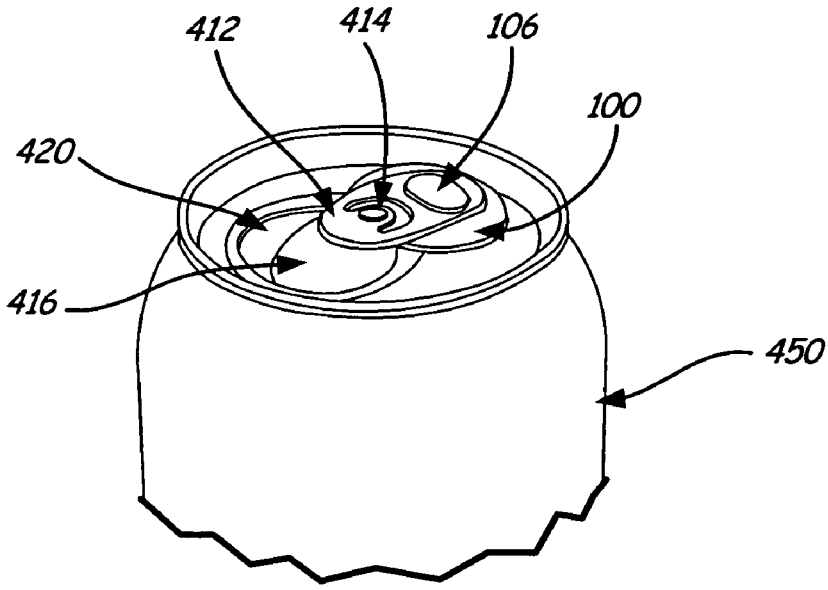
FIG. 5 is a top perspective view of a re-sealing mechanism engaged to a can.

FIGS. 4 and 5 are a schematic side cross-section view and a top perspective view, respectively, illustrating functionality associated with a re-sealing mechanism. In accordance with one aspect of the present invention, mechanism 100 is mounted on can 450 by pushing mount piece 106 through at least one of the apertures in can tab 412. Tab 412, as is typical of most cans, is mounted to can 450 by rivet 414. Mount piece 106 is pushed through tab 412 until flange 108 (shown in FIG. 1B) engages the top surface of tab 412. In accordance with one embodiment, mechanism 100 is attached to can 450 by pushing mount piece 106 through tab 412 from the bottom side of tab 412. However, mechanism 100 may be mounted using other means such as insertion thorough the top side of tab 412. Flange 108, which has a diameter larger than that of the aperture in tab 412 through which it is mounted, holds mechanism 100 securely to tab 412.

In accordance with one aspect of the present invention, as is typical of most cans, tab 412 is used to open seal 416, creating opening 420, for drinking or other purposes. As was mentioned above, one problem with cans is their inability to be re-sealed after opening.

In accordance with another aspect of the present invention, mechanism 100 is positioned over the opening of can 450. FIGS. 6A and 6B are top views of a can illustrating operation and alignment of a re-sealing mechanism. Tab 412, after opening the can, is then rotated about rivet 414 until the edges of inner flange 104 of mechanism 100 (shown in FIG. 1B) are aligned with the edges of the can opening 420. Alignment of mechanism 100 with the can opening is shown in FIG. 6B.

Figure 7:
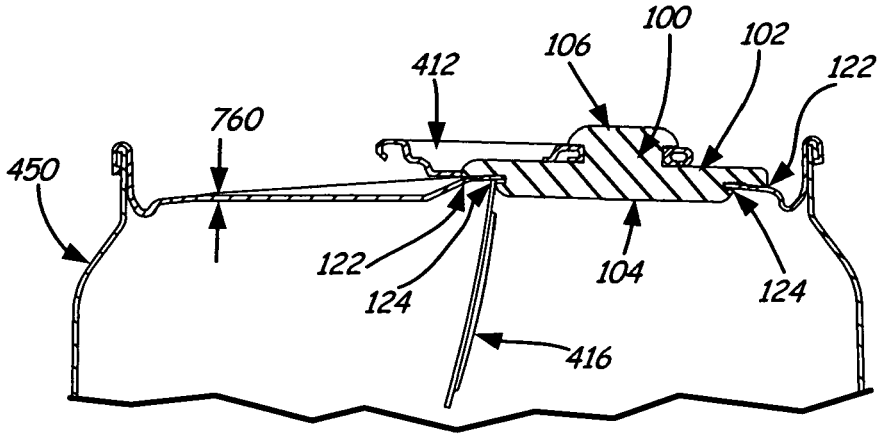
FIG. 7 is a schematic side cross-section view illustrating additional functionality associated with a re-sealing mechanism.

In accordance with one aspect of the present invention, with reference to FIG. 7, re-sealing mechanism 100 is pushed downward causing inner flange 104, which is slightly larger than the can opening, to deform or elongate. Mechanism 100 is pushed downward until the top edges 124 of inner flange 104, also shown in FIG. 1B, enter the can opening and engage with the inner surface of the can. In accordance with another aspect, the edges 124 of inner flange 104 are such that a sealing engagement is created. At the same time, bottom edges 122 of outer flange 102, also shown in FIG. 1B, create a similar seal with the outer surface of can 450.

In accordance with one embodiment of the present invention, the space 110 between outer flange 102 and inner flange 104, shown in FIG. 1B, is substantially the same as the thickness 760 of can 450. In another embodiment, space 110 is greater than can thickness 760 enabling inner and outer flanges to be easily positioned to engage the surfaces of the can proximate the opening. In this illustrated embodiment, inner flange 104 is constructed of an exceptionally deformable material, such as previously listed, to create a sealing engagement. In yet another embodiment, space 110 is slightly less than can thickness 760 causing flanges 102 and 104 to press tightly against the outer and inner surfaces of can 450, respectively, thus forming a tighter, more secure seal.

Figure 8:
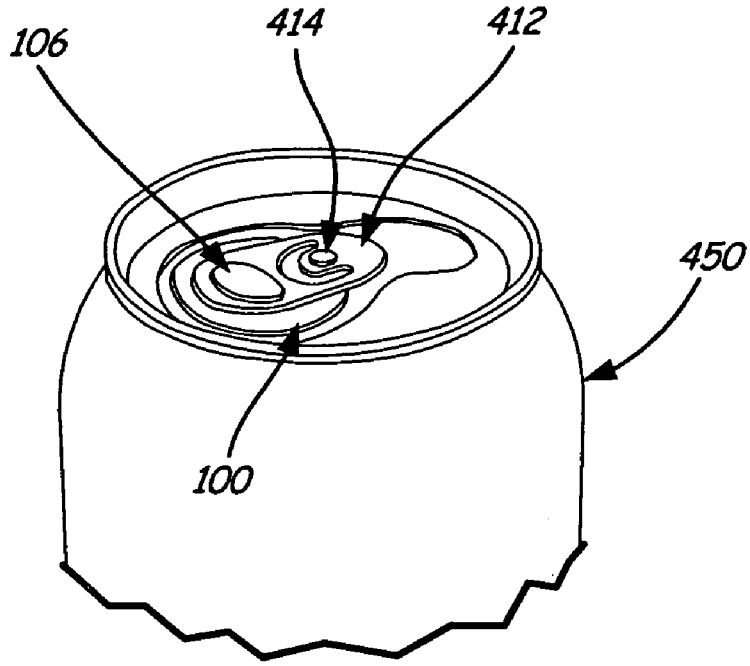
FIG. 8 is a top perspective view of a re-sealing mechanism engaged to a can.

FIG. 8 is a top perspective view of a re-sealing mechanism engaged to a can. The seal formed by flanges 102 and 104 of mechanism 100 with the surfaces of can 450 is such that a sealing engagement is created, minimizing or discouraging loss of carbonation, contamination of can contents, as well as discouraging the contents from being spilled.

In accordance with a previously mentioned aspect of the present invention, mechanism 100 may be removed from can 450 to allow the contents to be emptied and or consumed. Mechanism 100 is released from its engaged state by the consumer simply lifting the tab while also lifting the edge of the outer flange 102 thus causing inner flange 104 to deform. The deformation of inner flange 104 enables mechanism 100 to be removed from the can opening. Mechanism 100 is then manually moved away from the can opening thereby exposing the opening for drinking purposes. The configuration of mechanism 100 allows for it to be repeatedly used to re-seal cans to preserve their contents.

Although the present invention has been described with reference to preferred embodiments, workers skilled in the art will recognize that changes may be made in form and detail without departing from the spirit and scope of the invention.

What is claimed is:

1. A device for re-closing an opening in a can having a tab opener, an inner surface and an outer surface, wherein the device comprises:

a mount piece having an overall shape and flexibility that enables it to be pushed through at least one aperture formed in the tab opener, thereby securing the device to the tab opener; and a plug portion attached to the mount piece and configured to engage and at least partially close the opening in the can, wherein the plug portion has an overall size and shape such that it extends beyond the tab opener when the device is secured to the tab opener, and wherein the mount piece remains outside the can when the plug portion is engaged to the opening; wherein the plug portion comprises a plurality of flanges; wherein at least one flange is configured to engage the inner surface of the can and at least one flange is configured to engage the outer surface of the can; and wherein the at least one flange configured to engage the outer surface of the can includes an indentation configured to accommodate a rivet on the can when the plug portion is engaged to the opening in the can.

2. The device of claim 1 wherein the mount piece is substantially mushroom-shaped.

3. The device of claim 1 wherein the plug portion comprises at least one flange configured to be pushed through the opening in the can.

4. The device of claim 3 wherein the plug portion further comprises at least one flange of an overall size and flexibility that discourages it from being pushed through the opening in the can.

5. The device of claim 1 wherein the plug portion comprises a plurality of flanges configured to be pushed through the opening into the can.

6. The device of claim 1 wherein at least one flange configured to engage the outer surface of the can has a greater total circumference than any flange configured to engage the inner surface of the can.

7. The device of claim 1 wherein at least one of the flanges configured to engage the inner surface of the can is constructed of a deformable material biased toward recovering a neutral shape.

8. The device of claim 7 wherein at least one of the flanges configured to engage the inner surface of the can has a total circumference greater than the circumference of the opening in the can.

9. The device of claim 7 wherein at least one of the flanges configured to engage the inner surface of the can has a total circumference more than 10 percent greater than the circumference of the opening in the can.

10. The device of claim 1, wherein the tab opener has a length and a width and the opening in the can has a length and a width, wherein at least one of the length and the width of the tab opener is less than at least one of the length and width of the opening in the can.

11. The device of claim 1 wherein the at least one flange configured to engage the outer surface of the can is non-circular.

12. A device for re-closing an opening in a can having a tab opener, an inner surface and an outer surface, wherein the device comprises:

a substantially mushroom-shaped mount piece configured to be pushed through an aperture formed in the tab opener, thereby securing the device to the tab opener; and a plug portion attached to the mount piece and configured to engage and at least partially close the opening in the can, wherein the plug portion comprises an inner flange configured to engage the inner surface of the can and an outer flange configured to engage the outer surface of the can, the outer flange having an annular ring that protrudes toward the inner flange; wherein the outer flange includes an indentation configured to accommodate a rivet on the can when the plug portion is engaged to the opening in the can.

13. The device of claim 12 wherein the outer flange is non-circular.

* * * * *